United States Patent [19]

Eggleston

[11] 4,387,700

[45] Jun. 14, 1983

[54] WOODSTOVE HAVING EXHAUST FLOW COMPENSATION AND A METHOD FOR PROVIDING SAME

[76] Inventor: Merritt J. Eggleston, Sears Hill Rd., Richford, N.Y. 13835

[21] Appl. No.: 265,852

[22] Filed: May 21, 1981

[51] Int. Cl.[3] ..... F24C 1/14

[52] U.S. Cl. ..... 126/77; 126/290

[58] Field of Search ..... 126/61, 77, 290, 112, 126/312, 307 R, 289, 63, 66, 121, 136; 110/160; 237/53, 55; 98/48

[56] References Cited

U.S. PATENT DOCUMENTS

| | | | |
|---|---|---|---|
| 656,895 | 8/1900 | King . | |
| 692,164 | 1/1902 | Miller . | |
| 781,644 | 2/1905 | Fairbanks . | |
| 795,226 | 7/1905 | Jensen | 126/77 |
| 891,900 | 6/1908 | Belvin . | |
| 907,044 | 12/1908 | Harr . | |
| 1,439,925 | 4/1922 | Street . | |
| 1,967,128 | 4/1933 | Moser . | |
| 2,072,758 | 11/1934 | Libby . | |
| 2,842,076 | 7/1958 | Martin | 126/290 |
| 4,038,963 | 8/1977 | Dingwall . | |
| 4,184,473 | 1/1980 | McIntire | 126/77 |
| 4,285,325 | 8/1981 | Bellaff | 126/112 |

FOREIGN PATENT DOCUMENTS

| | | | |
|---|---|---|---|
| 408304 | 3/1910 | France | 126/77 |

*Primary Examiner*—James C. Yeung
*Attorney, Agent, or Firm*—Barnard & Brown

[57] ABSTRACT

A stove having automatic chimney air flow compensation for reductions in air flow to its combustion chamber is disclosed. An increase or decrease in compensatory air flow is dependent upon the movement of ganged dampers. The amount of compensatory chimney air flow is dependent upon the size and/or position of apertures and blocking portions formed respectively in the ganged dampers. The dampers can be configured, as appropriate, and thereby tuned, to be particularly responsive to local conditions.

The stove is provided with a conduit positioned to provide a source of fresh air. The conduit is clamped to the stove to heat the air flowing therein and thereby prevent exhaust gas condensation and creosote buildup when it rises in and from the chimney. One of the ganged dampers is inserted into the conduit and acts, due to the nature of its linkage with the stove damper, to block air flow therein when the linkage with the stove damper, to block air flow therein when the stove damper increases air flow to the combustion chamber and increase conduit air flow when the flow of stove inlet air is reduced. This inverse and automatic damper action makes it easy and efficient for a user to adjust stove combustion rates with significantly reduced concern about chimney fire.

6 Claims, 5 Drawing Figures

WOODSTOVE HAVING EXHAUST FLOW COMPENSATION AND A METHOD FOR PROVIDING SAME

BACKGROUND OF THE INVENTION

1. Field of the Invention

This invention relates to air-tight stoves and, in particular, to an improved air-tight stove having means for adjusting chimney air flow and temperature in response to an adjustment in stove adding to and maintaining proper chimney air flow and temperature when the stove's combustion inlet flow is reduced, thereby reducing the accumulation of creosote and other materials in the chimney greatly reducing the possiblity of chimney fires. It also relates to a method of achieving such proper chimney flow.

2. Description of the Prior Art

Wood burning stoves have recently surged in popularity and use due in large measure to the rising costs of conventional fuels. Air-tight wood stoves are one of the most useful types of stoves because of their ability to regulate and control air flow into the stove's combustion chamber. However, when air flow is reduced for extended periods, for example overnight, to slow down combustion rates, the concommitant reduction in the flow of hot chimney air allows combustable residue, most notably creosote, to build up especially in the chimney walls. Unfortunately, this residue is the source and most prevalent cause of chimney fires.

The need to prevent the buildup of combustable materials on chimney walls has long been recognized in the prior art. For example, U.S. Pat. No. 692,164 to Miller describes heating and ventilating apparatus for furnishing fresh air to be heated and for carrying off stagnant air, the apparatus including an outer casing for the heating stove wherein the fresh, outside air is heated to a suitable temperature prior to being introduced into the chimney flue. The freshly heated air is fed to the chimney at a point below that where the stove exhaust is introduced into the chimney flue. The freshly heated air is fed to the chimney at a point below that where the stove exhaust is introduced. Also of interest is the apparatus described by Belvin in U.S. Pat. No. 891,900, by Harr in U.S. Pat. No. 907,044 and by Street in U.S. Pat. No. 1,439,925. Each of these prior art arrangements illustrate ventilation apparatus for heating systems wherein fresh and/or stale air is used to supplement normal chimney flow. However, none of the above was concerned with the buildup of creosote or other combustible materials on the chimney walls.

In U.s. Pat. No. 1,967,128 to Moser, a ventilator device intended to prevent creosote buildup in a chimney is described. This apparatus relies on an auxiliary air flow supply pipe having an independent concavo-convex damper inserted at the intake end thereof. This damper is adapted to be regulated by wind induced draft to insure chimney flow and thereby hopefully prevent creosote buildup when the stove is banked. The auxiliary air flow is not directly heated by the stove in the Moser apparatus. A similar intent to prevent soot and creosote buildup is evidenced by the apparatus shown in U.S. Pat. No. 2,072,758 by Libby wherein a dual-baffle device is inserted in a chimney below the entry point of the stove exhaust pipe. The baffle is designed to prevent buildup in the flue below that entry point. This arrangement does not utilize an auxiliary air flow.

Unfortunately, the several prior art arrangements all fail to fully compensate for reduced air flow when the stove is banked and/or do not provide a source of warmed auxiliary air to prevent soot and creosote buildup in the chimney flue. It should be noted that a flow of cold or even room temperature air will not prevent exhaust gas condensation and subsequent buildup in the flue since lower exhaust gas temperatures tend to promote condensation of the gases.

OBJECTS AND SUMMARY OF THE INVENTION

It is therefore a primary object of the present invention to provide auxiliary air flow means for a dampable stove that will prevent soot and creosote buildup under a maximum number of conditions.

It is another primary object of the present invention to provide an auxiliary air flow for a dampable stove which can be adjusted contemporaneously with reductions in the stove's air supply.

It is a further object of the present invention to provide auxiliary air flow means which can be readily adjusted or tuned as a function of a particular stove installation.

It is also an object of the present invention to provide such an adjustable auxiliary air flow means which is inexpensive to implement and easy to use.

These and other desirable objects of the present invention are achieved through the use of auxiliary air flow means which are adapted to inject compensatory air flow, when a stove is damped, into the chimney flue of a stove installation above the entry point of the stove exhaust flue entry. The auxiliary air flow means includes conduit means for delivering fresh or ambient air, the conduit means being positioned in contact with the stove to warm the auxiliary air flowing therein. In addition, the stove damping means is coupled to a damper provided in the conduit means. The dampers are adapted to cause an inverse reaction in their respective functions. Thus, when air flow to the stove is restricted, increased air flow in the conduit means will result, precisely at the time such increased auxiliary flow is needed. A converse reaction takes place if and when air is needed. A converse reaction takes place if and when air flow to the stove is increased. By predetermined selection of the relative rate of inverse damper change, a particular stove installation can be tuned for local conditions.

BRIEF DESCRIPTION OF THE DRAWINGS

Referring now to the drawings wherein like reference numerals have been used in the several views to identify like elements.

DESCRIPTION OF THE PREFERRED EMBODIMENT

Figure 1:
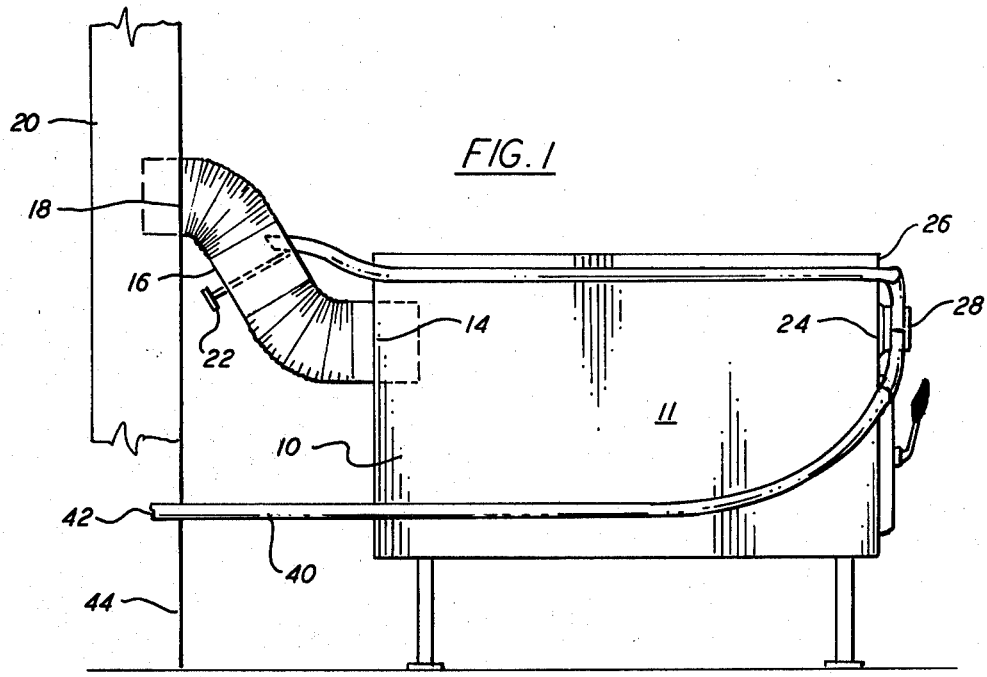
FIG. 1 illustrates a schematic representation of an air-tight wood stove that has been modified and installed in accordance with the present invention.

As is shown in FIG. 1, an air-tight wood stove 10 is installed in a conventional building for the purpose of heating the same or a portion thereof. The stove 10 includes a combustion chamber 11 which is provided with a fuel loading door 12 through which wood can be added or the fire stoked. The combustion chamber 11 is also provided with an exhaust aperture 14 through which the by-products of combustion are vented. Venting to outside the building is completely accomplished by connecting an exhaust pipe 16 between the stove's exhaust aperture 14 and the inlet aperture 18 of chimney 20. As shown in FIG. 1 the exhaust pipe 16 extends partially into both the stove 10 and the chimney 20. If desired, the exhaust pipe 16 can be fitted with a damper 22 of conventional design. When a fire is burning, the by-products of combustion are passed from the stove 10 to the chimney 20 and rise therein to the outside.

Figure 2:
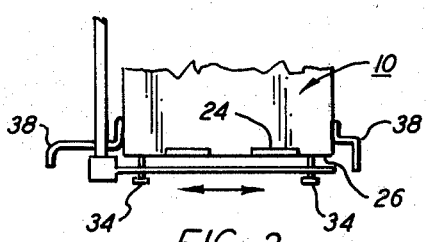
FIG. 2 is a top view of the stove which shows further details of the present invention, particularly some pertaining to the auxiliary air flow means and inversely ganged dampers thereof.

The air required to support combustion of both the fuel and some of the gasses produced by burning is admitted to the combustion chamber 11 by and through air intake ports 24 located in the front wall 26 of chamber 11. While it has been the generally accepted practice to locate air inlet ports in the front door of a stove, it has been found easier and simpler to implement the instant embodiment by forming the ports in the front wall 26 of the combustion chamber 11, as is shown in FIGS. 1 and 2.

Figure 3:
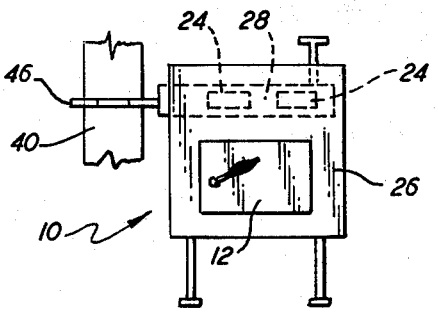
FIG. 3 is a front view of the stove which depicts additional details of the present invention.

The ports 24 are damped down or closed off by means of a slideably mounted damper 28 which is provided with at least one opening 30 of predetermined size therein. For purposes of this explanation, it will be assumed that there are two inlet ports 24 formed in the front wall 26 and two associated openings 30 formed in the damper 28. The damper 28 also includes two blocking portions 31 which would be located adjacent the openings 30. The damper 28 is moved, as required, by means of a handle 32 which is joined thereto and is preferably formed of a non-conductive material to protect a user. The damper 28 is held in place by supports 34 which are fixedly mounted or welded to the stove 10. Each of the supports 34 may be provided with slots which are sized to permit the damper 28 to be slideably held therein, as is depicted in FIG. 3. The maximum amount of damper travel is limited by the use of stops 38 which are positioned in the path of damper 28 travel as also illustrated in FIG. 2.

It should be noted that the physical distances between any relationship of the intake ports 24, the damper 28, the supports 34 as well as other parts to be hereinafter described, are shown in an exagerated manner for the sake of clarity. In actual practice however, the relative positions of these elements would be defined to insure that they would satisfactorily serve their intended purpose. In addition, attention is also directed to the fact that the internal baffling and configuration varies from stove to stove. Thus, the actual location of the inlet ports 24, at the top front of the combustion chamber 11, is a matter of simple design choice dictated by the internal configuration of a particular stove. It will be apparent that the inlet ports could be located at the bottom front of the stove or along its sides. The only constraint, consistent with internal stove baffling, is that the inlet ports and their damper cooperate with the regulation of the auxiliary air supply as hereinafter described.

The stove 10 shown in FIG. 1 also includes an auxiliary air flow conduit 40. It is mounted with its intake end 42 passing through an outside wall 44 and protruding therefrom. The inlet 44 gathers fresh air which flows, except as impeded, through the conduit 40. The conduit is bent to follow a path along and in intimate contact with the periphery of the stove 10. It is terminated at the exhaust pipe 16, passing therein above the damper 22. Alternatively, the conduit 40 can be terminated directly in the chimney 20. Due to its intimate contact along a substantial portion of its length which is insured by clamps 41 which secure the conduit 40 to the stove 10, the air within the conduit 40 is heated well above its normal or even room temperature, prior to being exhausted into the chimney 20.

As previously noted, there are times, such as overnight, when it is desirable to retard the combustion rate by damping down the stove 10 which means that the flow of inlet air into the combustion chamber 11 will be reduced. For the stove 10, this is accomplished by moving the damper 28 relative to the inlet ports so that the ports will be at least partially blocked. It will be evident to those having skill in this art that the damper 28 can be adapted to provide any reasonable predetermined degree of inlet port blockage per unit of damper movement by adjusting the shape and/or size of its apertures as shall hereinafter be explained.

Unfortunately, when a stove is operated in a damped condition for extended periods, particularly an air-tight stove, the reduction in air flow into the stove reduces the flow of exhaust gasses. This reduction in exhaust flow permits the buildup of soot and creosote on the internal chimney walls. Then, when the stove is fully loaded, the increased flow of very hot exhaust gasses can and do ignite the deposited materials causing a chimney fire. The present invention is particularly well suited to preventing this problem by providing a source of heated auxiliary air which does not flow through the combustion chamber 11. This means that the stove 10 can be damped when desired without causing concern over the reduced chimney air flow.

Figure 4A:
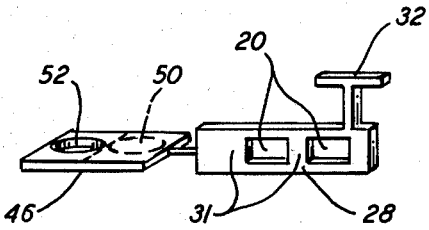
FIG. 4A and 4B respectively show two possible configurations of the inversely ganged dampers of the present invention.
Figure 4B:
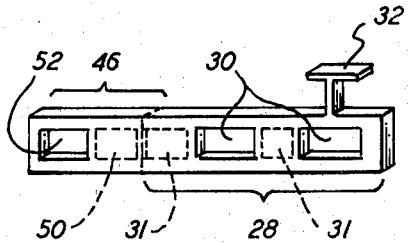

This is accomplished by joining or ganging a second damper 46 to damper 28. Due to their being ganged, movement of one damper causes movement of the other. The damper 46 fits into and is slideably supported by slots 48 that have been cut in conduit 40 for that purpose. For ease of fabrication, the slots 48 are formed in conduit 40 at a point where they intersect a horizontal plane that passes through the inlet ports 24. Damper 46 is provided with an aperture portion 52 and a blocking portion 50 that are positioned to alternatively permit or restrict air flow in the conduit 40 when appropriately positioned therein. If the conduit 40 passes its intersection point with the damper 46 in a generally horizontal orientation then the dampers 46 and 28 will lie in the same plane as is depicted in FIG. 4B. If the conduit 40 passes its intersection point with the damper 46 in a generally vertical position then the damper 46 will be ganged at right angles to the damper 28 as evidenced in FIG. 4A.

The respective aperture and blocking portions of the dampers 28 and 46 are arranged therein so that air flow in conduit 40 will be substantially or completely blocked by its blocking portion 52 when damper 28 causes its apertures 30 to be aligned with the inlet ports 24 leaving them wide open to admit a maximum amount of air into the combustion chamber 11. Conversely, the air flow in conduit 40 is left unrestricted by the aperture portion 52 of damper 46 when the inlet ports 24 are maximally blocked by the blocking portions 31 of damper 28. It will be easily recognized at this point that the action of the dampers 28 and 46 is inverse and that it is continuous. Thus, it is possible for a user to automatically, but very simply, make compensatory adjustments in total air flow to a chimney whether the stove to be regulated is to be damped down or fired up. Further, that adjustment is continuous over the entire range encountered by the user and requires no reference to gauges or reference marks for the adjustment to be effected.

It can be seen that the inverse relationship between the flow of air into the combustion chamber 11 and in conduit 40 can be adjusted or tuned as desired since the size and/or position of the respective apertures and blocking portions in dampers 28 and 46 can be selected to yield any predetermined relationship in the resultant mutual action of the dampers 28 and 46. As a result, this relationship can be inversely identical, linear or a predetermined non-linear function, which is obtained by simply configuring the damper portions as would be germane to the desired end result. If appropriate to and depending upon local conditions or the constraints of stove installation, such as for example stronger than usual prevailing winds or a non-standard chimney size, the dampers 28 and 46 can be selected to yield air flow relationships that are particularly suited for that operating environment.

While the present invention has been described in the context of a preferred embodiment thereof, it will be readily apparent to those skilled in the appertaining art, that modifications and variations can be made therein without departing from the spirit and scope of the present invention. Accordingly, it is not intended that the present invention be limited to the specifics of the foregoing description of the preferred embodiment. Instead, the present invention is to be considered as being limited solely by the appended claims which alone are intended to define its scope.

Having thus described my invention, what I desire to secure by Letters Patent is described below:

1. Apparatus for compensatory control of air flow to a wood stove having a combustion chamber, at least one inlet port for admitting air from a main source therefor into said combustion chamber, an exit port for exhausting the byproducts of combustion therefrom, a chimney and an exhaust pipe coupling said exit port to said chimney, said apparatus comprising:

(a) conduit means for heating and conveying auxiliary air, positioned in contact with the stove, connected between a source of auxiliary air and said chimney, for exhausting heated auxiliary air into said chimney; and (b) damper means, for controlling the flow of air into the stove and within said conduit means, having first and second ganged sections, mounted in movable relationship within said conduit means and to said inlet port, with said first section positioned to slide in front of said inlet port and said second section positioned to slide within said conduit means, said first and second sections each having an aperture portion and a blocking portion, said blocking portion of said first section being positioned in said damper means to block said inlet port at the same time that said aperture portion of said second section permits the flow of auxiliary air within said conduit means and section blocking portion of said second section being positioned in said damper means to block the flow of air in said conduit means at the same time that said aperture portion of the first section permits the flow of air into said combustion chamber through said inlet port.

2. The apparatus according to claim 1 wherein said conduit means is positioned within said combustion chamber so that air flowing therewithin is heated.

3. The apparatus according to claim 1 wherein the size of each of said first and section blocking and aperture portions are predetermined to effect a known inverse relationship between the flow of air from the main and auxiliary sources thereof.

4. The apparatus according to claim 3 wherein said predetermined inverse relationship is linear.

5. The apparatus according to claim 3 wherein said predetermined relationship is nonlinear.

6. A method for providing automatic and predetermined compensatory air flow from an auxiliary supply to the chimney of a wood stove having a main source of combustable air when the inlet port of the stove is to be damped, said method comprising the steps of:

(a) using a conduit to transport auxiliary air from a source thereof to the chimney to which the stove is connected;

(b) heating the air flowing within the conduit by placing the conduit in contact with the stove;

(c) slideably mounting a first damper having a blocking portion and an aperture portion within said conduit to control the flow of auxiliary air therein;

(d) slideably mounting a second damper having a blocking portion and an aperture portion in front of the inlet port to the combustion chamber of the stove; and (e) ganging the first and second dampers together so that they move simultaneously, with the blocking portion of the first damper blocking the flow of auxiliary air within the conduit at the same time that the aperture portion of the second damper is positioned to permit air flow into the stove through the inlet port thereof and the blocking portion of the second damper blocking the flow of air through the inlet ports of the stove at the same time that the aperture portion of the first damper permits the flow of auxiliary air in the conduit.

* * * * *